US006487273B1

(12) United States Patent
Takenaka et al.

(10) Patent No.: US 6,487,273 B1
(45) Date of Patent: Nov. 26, 2002

(54) X-RAY TUBE HAVING AN INTEGRAL HOUSING ASSEMBLY

(75) Inventors: Jeff Takenaka, Salt Lake City, UT (US); Scott Coles, Salt Lake City, UT (US); Mark Lange, Salt Lake City, UT (US); Karen Quinn, Salt Lake City, UT (US); Christopher Artig, Summit City, UT (US); Jim Burke, Glenview, IL (US); Brian Carsten, Park City, UT (US); Craig Smith, Herriman, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/989,239

(22) Filed: Nov. 20, 2001

Related U.S. Application Data

(63) Continuation-in-part of application No. 09/449,411, filed on Nov. 26, 1999.

(51) Int. Cl.[7] ..... H01J 35/10

(52) U.S. Cl. ..... 378/142; 378/131; 378/199; 378/201

(58) Field of Search ..... 378/121–144, 378/199–202

(56) References Cited

U.S. PATENT DOCUMENTS

| | | | | |
|---|---|---|---|---|
| 3,334,256 A | | 8/1967 | Gager | 313/110 |
| 4,079,217 A | | 3/1978 | Oeschger | 200/144 |
| 4,355,410 A | | 10/1982 | Sullins | 378/199 |
| 4,384,360 A | | 5/1983 | Kitadate et al. | 378/202 |
| 4,811,375 A | | 3/1989 | Klostermann | 378/131 |
| 4,841,557 A | | 6/1989 | Haberrecker et al. | 378/141 |
| 4,884,292 A | | 11/1989 | Klostermann | 378/127 |
| 4,928,296 A | | 5/1990 | Kadambi | 378/141 |
| 5,056,126 A | | 10/1991 | Klostermann et al. | 378/127 |
| 5,425,067 A | | 6/1995 | Sano et al. | 378/125 |
| 5,515,413 A | | 5/1996 | Knudsen et al. | 378/136 |
| 5,703,924 A | | 12/1997 | Hell et al. | 378/136 |
| 5,802,140 A | | 9/1998 | Virshup et al. | 378/136 |
| 5,828,727 A | | 10/1998 | Schild | 378/140 |
| 6,075,839 A | * | 6/2000 | Treseder | 378/140 |
| 6,134,299 A | | 10/2000 | Artig | 378/121 |
| 6,252,933 B1 | | 6/2001 | Artig | 378/121 |

FOREIGN PATENT DOCUMENTS

| | | |
|---|---|---|
| EP | 0 051 295 A | 5/1982 |
| EP | 0 477 857 | 4/1992 |
| EP | 0 833 365 A | 4/1998 |
| GB | 817 941 A | 8/1959 |

* cited by examiner

*Primary Examiner*—Craig E. Church
(74) *Attorney, Agent, or Firm*—Workman, Nydegger & Seeley

(57) ABSTRACT

The present invention is directed to a radiographic apparatus that utilizes a single integral housing for providing an evacuated envelope for an anode and cathode assembly. The integral housing provides sufficient radiation blocking and heat transfer characteristics such that an additional external housing is not required. The integral housing is air cooled, and thus does not utilize any coolant. In addition, the integral housing is insulated with a potting material, which electrically insulates the integral housing and its components, and also limits the amount of noise emitted from the housing during operation. In an alternative embodiment, enhanced thermal and electrically insulating properties are achieved through the use of a potting material disposed in selected areas of the tube interior. The potting material cooperates with optimized airflow through the tube assembly to effectively and continuously remove heat therefrom.

55 Claims, 6 Drawing Sheets

X-RAY TUBE HAVING AN INTEGRAL HOUSING ASSEMBLY

RELATED APPLICATIONS

This application is a continuation-in-part of U.S. patent application Ser. No. 09/449,411, filed on Nov. 26, 1999, which is incorporated herein by reference.

BACKGROUND OF THE INVENTION

1. The Field of the Invention

The present invention relates to x-ray generating devices. More particularly, the present invention relates to an x-ray tube having an integral housing assembly that allows for improved performance, reliability, safety and patient comfort.

2. The Relevant Technology

X-ray devices are extremely valuable tools for use in a variety of medical applications. For example, such equipment is commonly used in areas such as diagnostic and therapeutic radiology.

Regardless of the particular application involved, the basic operation of medical x-ray devices is similar. In general, x-rays, or x-ray radiation, are produced when electrons are produced, accelerated to high speeds, and then stopped abruptly. Typically, this entire A process takes place within an x-ray tube housing that defines an evacuated envelope. This evacuated envelope is typically constructed of glass, metal, or a combination of metal and glass. Disposed within the evacuated envelope is a cathode assembly, which produces the electrons, and an anode assembly, which is axially spaced apart from the cathode and oriented so as to receive electrons emitted by the cathode.

In operation, a voltage potential is applied between the cathode and the anode. This potential causes the electrons that are emitted from the cathode filament to form a thin stream or beam, and accelerate to a very high velocity towards a target surface positioned on the anode. This target surface (sometimes referred to as the focal track) is comprised of a refractory metal having a high atomic number, so that when the electrons strike it, at least a portion of the resulting kinetic energy is converted to electromagnetic waves of very high frequency, i.e., x-rays. The resulting x-rays emanate from the target surface, and are then collimated for penetration into an object, such as an area of a patient's body. As is well known, the x-rays that pass through the object can be detected and analyzed so as to be used in any one of a number of applications, such as a medical diagnostic examination.

In general, a very small part of the input energy results in the production of x-rays. A majority of the kinetic energy resulting from the electron collisions at the target surface is converted into heat, which can reach extremely high temperatures. The heat is absorbed by the anode and is conducted not only to other portions of the anode assembly, but to the other x-ray tube components within the evacuated envelope. Over time, this heat can damage the anode, the anode assembly, and/or other tube components, and can reduce the operating life of the x-ray tube and/or the performance and operating efficiency of the tube.

Several approaches have been used to help alleviate problems arising from the presence of these high operating temperatures. For example, in some x-ray devices the x-ray target, or focal track, is positioned on an annular portion of a rotatable anode disk. The anode disk (also referred to as the rotary target or the rotary anode) is then mounted on a supporting shaft and rotor assembly that can then be rotated by a motor. During operation of the x-ray tube, the anode disk is rotated at high speeds, which causes the focal track to continuously rotate into and out of the path of the electron beam. In this way, the electron beam is in contact with any given point along the focal track for only short periods of time. This allows the remaining portion of the track to cool during the time that it takes to rotate back into the path of the electron beam, thereby reducing the amount of heat absorbed by the anode.

While rotation of the anode reduces the amount of heat present at the focal spot on the focal track, a large amount of heat is still transferred to the anode, the anode drive assembly, and other components within the evacuated housing. This heat must be continuously removed to prevent damage to the tube (and any other adjacent electrical components) and to increase the x-ray tube's efficiency and overall service life.

One approach has been to place the housing that forms the evacuated envelope within a second outer metal housing, which is sometimes referred to as a "can." This outer housing or can serves several functions. First, it acts as a radiation shield to prevent radiation leakage. As such, it must be at least partially constructed from some type of dense, x-ray absorbing metal, such as lead. Second, the outer housing serves as a container for a cooling medium, such as a dielectric oil, which is circulated by a pump over the outer surface of the inner evacuated housing. As heat is emitted from the x-ray tube components (anode, anode drive assembly, etc.), it is radiated to the outer surface of the evacuated housing, and then at least partially absorbed by the coolant fluid. The heated coolant fluid is then passed to some form of heat exchange device, such as a radiative surface, and the heat is removed. The fluid is then re-circulated by the pump back through the outer housing and the process repeated.

The dielectric oil (or similar fluid) is also often relied upon to provide functions other than cooling. For example, the oil serves as an electrical insulator between the inner evacuated housing, which contains the cathode and anode assembly, and the outer housing, which is typically comprised of a conductive metal material. The presence of the fluid insulator reduces the possibility of electrical arcing between the evacuated housing and the outer housing, and also provides electrical insulation between any high voltage leads connected to the evacuated envelope.

While useful as a heat removal medium and/or as an electrical insulator, the use of oil and similar liquids can be problematic in several respects. For example, use of a fluid adds complexity to the construction and operation of the x-ray generating device in several areas. First, use of fluid requires that there be a second outer housing or can structure to retain the fluid. This outer housing is constructed of a material that is capable of blocking x-rays, and it must be large enough to be completely disposed about the inner evacuated housing and allow fluid to be disposed therein. This increases the cost and manufacturing complexity of the overall device. Also, the outer housing requires a large amount of physical space, resulting in the need for an overall larger x-ray generating device. This can limit the device's ability to be used in close proximity to a patient and/or can increase discomfort to the patient during certain types of procedures.

Also, the space required for the outer housing reduces the amount of space that can be utilized by the inner evacuated housing, which in turn limits the amount of space that can be used by other components within the x-ray tube. For example, the size of the rotating anode is limited; a larger diameter anode is often desirable because it is better able to dissipate heat as it rotates.

The need for an outer housing adds expense and manufacturing complexity to the overall device in other respects. When liquid is used as a coolant, the device may need a pump and a radiator (or similar heat removal device), that in turn must be interconnected within a closed circulation system via a system of tubes and fluid conduits. Also, since the oil expands when it is heated, the closed system must provide a facility to expand, such as a diaphragm or similar structure. Again, these additional components add complexity and expense to the x-ray device's construction. Moreover, the tube is more subject to fluid leakage and related catastrophic failures attributable to such a fluid system.

The presence of a liquid coolant/dielectric is also detrimental because it does not function as an efficient noise insulator. In fact, the presence of a liquid may tend to increase the mechanical vibration and resultant noise that is emitted by the operating x-ray tube. This noise can be distressing to the patient and/or the operator. The presence of liquid also limits the ability to utilize other, more efficient materials for dampening the noises emitted by the x-ray tube due to space restrictions and the need for effective electrical insulation.

Use of a liquid coolant gives rise to safety concerns as well. In particular, during operation, the temperature of the coolant reaches extremely high temperatures. The structures containing the fluid must therefore be extremely robust to insure that there is never any accidental leakage. This need is especially acute since the x-ray tube is often in very close proximity to a patient. Obviously, any leakage could be catastrophic.

Use of liquid coolant is problematic in yet another respect. In particular, the need to dispose of a dielectric oil, as well as the lead-lined outer housing, gives rise to a number of environmental concerns. In particular, the disposal of such materials is often governed by strict local and national regulations. Compliance is often expensive and time consuming, which adds to the cost of using such equipment.

Some prior art x-ray tubes have eliminated the use of an outer housing and fluid as a coolant/dielectric medium. For example, some solutions utilize forced air to remove heat from the evacuated housing and its components. However, these approaches have not been entirely satisfactory for a variety of reasons. Also, proposed solutions are not well suited for certain types of x-ray applications, such as x-ray mammography and similar applications.

For example, known x-ray generating devices that utilize forced air as a cooling medium are adapted for high voltage x-ray applications; such applications typically utilize a 150 kV operating potential, or higher, between the anode and cathode. High operating voltages result in higher operating temperatures, and to ensure sufficient heat removal with air convection, these x-ray tubes typically are equipped with fins, or channels formed on the outer surface of the evacuated envelope so as to enhance heat removal. As with previous solutions, this need for additional structure increases manufacturing complexity, and involves additional physical space requirements for the assembly. Moreover, in these types of devices, since the outer housing is eliminated, the housing forming the evacuated enclosure must provide a sufficient level of radiation shielding. To do so at such higher operating voltage levels, the walls that form the enclosure must either be very thick, or must be constructed of more expensive materials. Again, this requires increased physical space and/or results in higher manufacturing costs.

In addition to the increased shielding capacity that must be provided by the walls of the evacuated enclosure, prior art devices must also provide additional shielding within the enclosure itself. For instance, openings are typically provided through the top and bottom portions of the evacuated housing, for example, to allow for the passage of electronic wires to the cathode assembly. Additional shielding structure must be provided so as to block any x-rays from escaping through these openings. Again, this adds to the amount of physical space that is available to other components, and increases manufacturing complexity of the x-ray tube.

Radiographic devices utilizing air cooling must also replace the dielectric oil as the means for electrically insulating the evacuated envelope (the cathode and the anode) from the rest of the assembly. Also, the device must provide some facility for reducing the amount of noise emitted by the x-ray tube during operation. As previously noted, the occurrence of noise resulting from a rotating anode can be especially troublesome to patients during some applications, such as mammography procedures.

Thus, what is needed in the art is a radiographic device that does not require the use of an outer housing for containing oils or similar fluids for the removal of heat and/or for providing an electrical insulator. Such a device would thereby eliminate the liabilities associated with the use of such fluids, such as increased manufacturing complexity, potential for failure, the need for increased physical space and problems associated with the proper disposal of the fluid. The device should also preferably maintain safe levels of radiation containment, and should also emit low amounts of audible noise during operation. Finally, the device must be extremely safe in all respects, and should present minimal environmental problems.

BRIEF SUMMARY OF EMBODIMENTS OF THE INVENTION

Briefly summarized, embodiments of the present invention are directed to an x-ray generating apparatus that eliminates the need for a liquid coolant contained within an outer x-ray tube housing or "can." Instead, embodiments utilize an x-ray tube having a single integral housing assembly that is capable of providing the vacuum enclosure that contains the cathode and anode assemblies. Moreover, the assembly is designed so as to provide a sufficient level of cooling and radiation blocking. In preferred embodiments, the x-ray generating apparatus of the present invention is particularly adapted for use in low power applications, where the energy potential between the anode and the cathode is approximately 25–30 kV, with an operating current at approximately 80–100 mA. These lower kV levels produce x-rays that have a lower energy spectrum, and the lower energy x-rays are better absorbed by softer breast tissue, resulting in an overall better contrast in the resulting x-ray image. However, it will be appreciated that embodiments of the invention can also be used with other applications and environments, including applications utilizing higher power. Also, embodiments of the present invention are applicable to a variety of voltage potential configurations, including a grounded anode mode, a grounded cathode mode, double ended mode, or any other appropriate combination depending on the needs of the particular application.

In one embodiment, the single integral housing is formed as a generally cylindrically shaped body. Supported on a cathode mounting structure within the interior of the housing is a cathode having an emission source, such as a filament, for emitting electrons. The cathode is supported so as to be positioned opposite from a focal track formed on a rotating anode. The focal track is positioned on the anode so that x-rays are emitted through a window formed through the side of the housing. In one embodiment, the cathode is freely supported on the cathode mounting structure, insofar as it is supported without the use of an oversized radiation shield or disk for blocking x-rays from exiting an opening formed through the housing. The elimination of a need for a larger x-ray blocking disk on the cathode frees up space within the interior of the housing for use by other components, and reduces overall manufacturing complexity and cost. In preferred embodiments, portions of the cathode itself are constructed with a radiation blocking material, which prevents x-rays from exiting the opening formed through the housing. In another preferred embodiment, the cathode mounting structure is shortened, allowing for the implementation of an x-ray tube having a shorter overall length. In another embodiment, the use of a cathode support arm is eliminated entirely, and the cathode is attached directly to the interior surface of the evacuated housing, or is integrated within the wall of the housing itself. Again, this shortens the length of the x-ray tube. In certain applications—especially mammography—this can improve patient comfort, as well as allow for a greater freedom of maneuverability of the x-ray generating apparatus.

In one embodiment, at least a portion of the integral housing is formed of low cost material such as copper, stainless steel, alloys thereof, or any other material that possesses thermal conduction characteristics that allow heat to be absorbed from the anode assembly during operation, and then conducted to the outer surface of the integral housing. Also, at least that portion of the housing that is adjacent to the rotating anode includes walls that are of sufficient thickness so as to block x-rays, preferably in a manner so as to comply with applicable FDA requirements. When used in a lower power mammography application, the x-rays are of relatively lower intensity, and thus the wall thickness needed to shield x-rays is relatively low—even with copper or stainless steel. Again, this reduces the overall size of the integral housing, as well as its cost. Other materials, including those that exhibit a higher degree of x-ray blocking characteristics, could also be used.

Preferred embodiments of the present invention utilize a forced air convection system to remove heat that is transferred to the outer surface of the integral housing, and to remove heat emitted from the stator, or motor assembly that is used to rotate the anode drive assembly. This eliminates the need for coolant fluids, such as dielectric oil and the like, and therefore eliminates the problems inherent with the use of such fluids. In one embodiment, a fan is used to direct air over the outer surfaces of the integral housing; preferably the airflow is directed with an airflow shell that is disposed about at least a portion of the integral housing. In some embodiments, a particular airflow to obtain optimal cooling can be provided by positioning air flow directors at specific locations within the airflow shell. The heat transfer characteristics of the integral housing, together with the cooling airflow, provide a sufficient level of heat removal so that the integral housing does not require external or internal fins, channels, or other similar means for conducting heat away from the surface. This, too, reduces manufacturing complexity, and reduces the overall physical size of the evacuated housing. It will be appreciated however that, depending on the needs of a particular application, such structures could be utilized to provide even further cooling of the integral housing.

Presently preferred embodiments of the present invention also include means for insulating the evacuated housing. In preferred embodiments, an electronic potting compound or encapsulant is used for the insulating means. For example, in one embodiment a dielectric gel is disposed between the integral housing and points external to the housing. A variety of other potting materials could be also used. Depending on the needs of the particular application, the material used preferably provides several functions. First, it the material may provide an electrical insulating function. For example, it may electrically insulate the high voltage (or ground—depending on the configuration) connection to the anode assembly, thereby preventing arcing and charge up of the evacuated integral housing (especially if there is a glass portion). Second, the material may preferably act as a dampening material that absorbs vibration and acoustical noise that originates from the anode rotor assembly. Reduced noise emissions are especially important to maintain the comfort of the patient and to help reduce any anxiety that would otherwise result from high noise emissions. Third, in some embodiments, the material may include an amount of a radiopaque material to provide additional levels of x-ray shielding to the integral housing. Finally, in preferred embodiments, the potting material is thermally conductive, so that it conducts heat away from surfaces it contacts. For example, the potting material would conduct heat away from portions of the evacuated housing, further enhancing the overall cooling of the operating x-ray tube.

In preferred embodiments, the insulating material, such as a potting compound, is positioned within selected areas of the x-ray tube assembly by way of an insulating shield positioned about portions of the evacuated housing. For example, the shield may be positioned about selected portions of the housing so as to define a gap between the shield and the outer surface of the housing. The potting material can then be placed within these gaps. The shield can also be used to form other chambered areas or volumes for containing the insulating material, depending on the needs of the application.

Some embodiments may optionally have additional features relating to the improved operation of the tube. For example, embodiments may include environmental sensors and controls for evaluating and controlling the operating environment within the evacuated housing, such as temperature regulation. Thus, in one embodiment, temperature sensors could be positioned within the evacuated housing, and airflow from a variable speed fan could be adjusted depending on temperature conditions. Alternatively, operation of the tube could be halted in the event that a maximum operating temperature is exceeded. Sensors for monitoring other environmental conditions, such as humidity could also be used. Also, devices that monitor electrical current and/or voltage levels could be utilized to monitor and protect electrical components, including the cathode filament, from various fault conditions such as filament over-current.

These and other advantages and features of the present invention will be apparent to those of skill in the art after having read the following detailed description of preferred embodiments, and the claims that follow.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only typical embodiments of the invention and are not therefore to be considered to be limiting of its scope, the invention will be described and explained with additional specificity and detail through the use of accompanying drawings in which.

DETAILED DESCRIPTION OF PRESENTLY PREFERRED EMBODIMENTS

Figure 1:
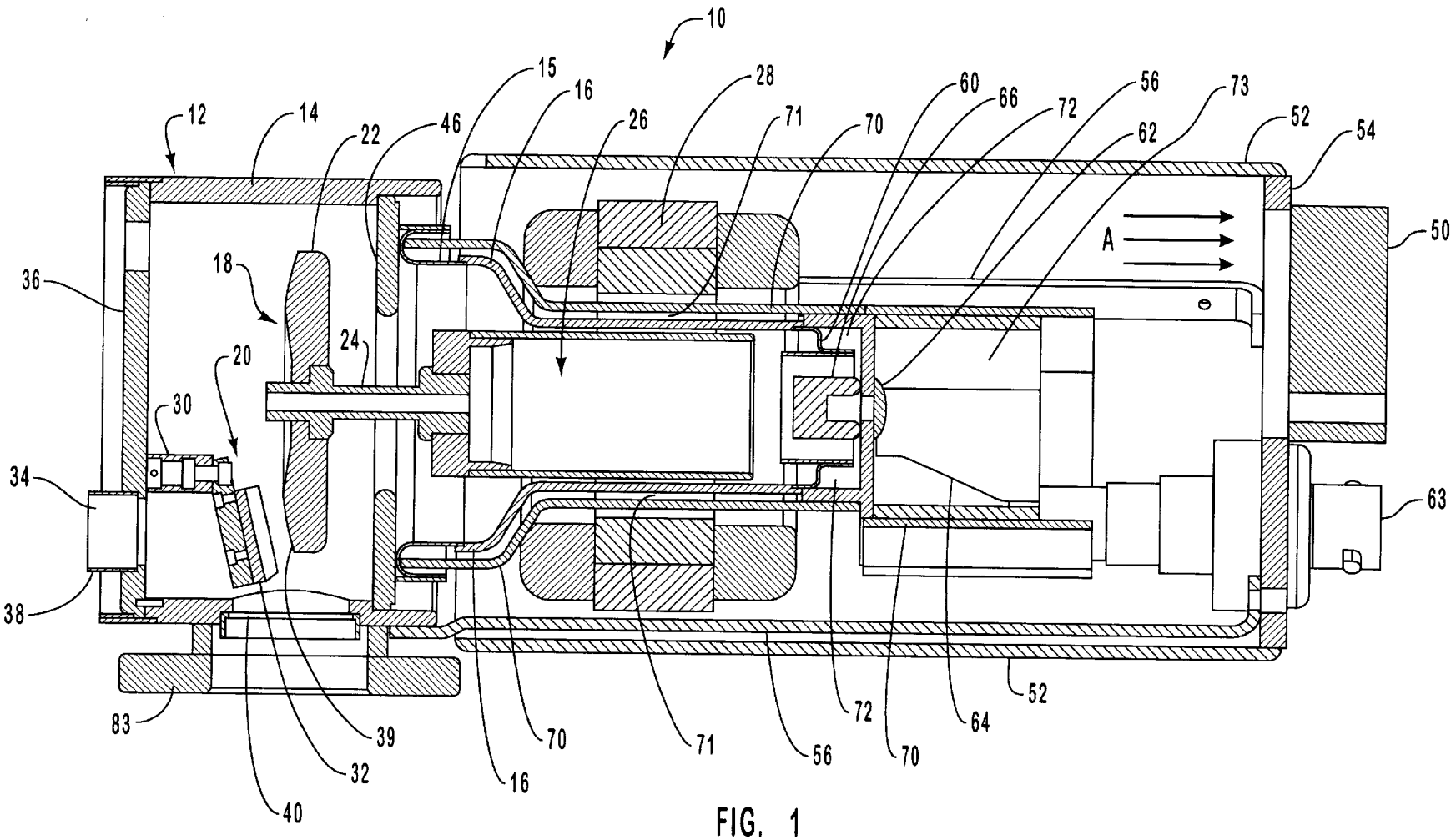
FIG. 1 is a cross-sectional elevational view of one embodiment of an x-ray tube assembly having a single integral housing constructed in accordance with the teachings of the present invention.

Reference will now be made to the drawings, wherein presently preferred embodiments of the present invention are illustrated. FIG. I illustrates a cross-sectional view of an x-ray tube assembly, designated generally at 10, which is constructed with a single integral housing assembly. The single integral housing, designated generally at 12, forms an evacuated enclosure in which is disposed the various x-ray tube components. In the illustrated embodiment, the integral housing 12 is comprised of a first envelope portion 14 and a second envelope portion 16. In this embodiment, the first envelope is comprised of copper, although other materials having a similar density and vacuum characteristics could also be used. For example, stainless steel could also be used. The second envelop portion 16 is comprised of glass, or other similar material. A vacuum tight seal is formed between the first and second envelopes, and in one preferred embodiment a kovar ring 15 and a nickel weld is used. Any other appropriate technique could also be used.

Disposed within the integral housing 12 is a rotating anode assembly 18 and a cathode assembly 20. The rotating anode assembly 18 includes a rotating anode target 22, which is connected via a shaft 24 to a rotor 26 for rotation. A stator 28 is disposed outside of the integral housing 12 at a point that is proximate to the rotor 26. The stator 28 is used to rotate the anode 22.

In the illustrated embodiment, the cathode assembly 20 includes a mounting arm 30. The cathode assembly 20 also includes a cathode head 32 and a means for emitting electrons, such as a filament (not shown). The cathode assembly 20 is placed within the vacuum enclosure formed by the integral housing 12. Wires (not shown) for connecting the cathode assembly to an external power source (not shown) pass through the opening 34, which is sealed vacuum tight with a ceramic insulator 38 or the like. In the illustrated embodiment, the cathode head 32 is supported by the mounting arm 30 in a manner that does not require the use of a radiation blocking shield or disk. In large part, such additional structure for blocking x-rays from exiting the ceramic opening is not needed in the illustrated embodiment, which finds particular use in mammography applications. As will be discussed further, in such an application the cathode assembly is placed at a very low voltage potential, and the first envelope portion 14 is placed at ground potential. This reduces the need for additional structure for radiation blocking as part of the cathode assembly 20, and thereby frees up space within the vacuum enclosure that can be utilized by other components, as will be further discussed.

A voltage generation means (not shown) is used to create a voltage potential between the cathode assembly and the anode assembly. This causes the electrons that are emitted from the filament of the cathode assembly to accelerate towards and then strike the surface of the anode at a point on the focal track 39, which is comprised of molybdenum (or a similar high Z material). Part of the energy generated as a result of this impact is in the form of x-rays that are then emitted through a x-ray transmissive window 40 that is formed through a side of the integral housing 12 at a point adjacent to the anode 22. As noted, in a presently preferred embodiment, the x-ray tube assembly of FIG. 1 finds particular applicability in mammography applications. By way of example, during operation in this environment, the anode assembly is maintained at a positive voltage of approximately 25–30 kV and approximately 80–100 mA. This lower kV level produces x-rays that have a lower energy spectrum, which are absorbed by softer breast tissue and thereby produce x-ray images having improved image quality.

Note that while the embodiment here is begin illustrated and described as having a particular operating configuration with respect to voltage potentials, the invention is not limited to such a configuration. In fact, any one of a number of different voltage potential configurations could be used depending on the needs of a particular application, including a grounded anode mode, a grounded cathode mode, a double ended mode or any suitable combination.

In this illustrated embodiment, the first envelope portion 14 of the integral housing 12 serves as a radiation shield. Due to the lower energy x-rays used in the preferred embodiment, this function can be satisfactorily provided by way of the copper material (or other similar material, such as stainless steel) used in the first envelope 14, and can be done so with a relatively small thickness. In the preferred embodiment, satisfactory shielding is obtained with a copper wall thickness of approximately 0.25 of an inch, which is substantially smaller than that used in prior art devices. A copper material (or its equivalent) of this thickness provides shielding such that radiation leakage does not exceed 20 mRad/Hr at 55 kV and 4 mA at 1 meter distance, when operated at the above power levels.

In the illustrated embodiment, the integral housing 12 further includes an anode plate 46 formed on the side of the anode disk 22 opposite from the cathode assembly 20. The anode plate is also formed of copper, or a similar material, and functions as a high voltage shield and as an internal radiation shield.

In addition to providing a radiation blocking function, the integral housing 12 provides yet another function. In particular, the first envelope portion 14 absorbs and thermally conducts heat away from the anode assembly 18, which is generated during operation. Again, the thermal characteristics of copper are ideally suited for this function. Moreover, given the thermal operating characteristics in a mammography applications, heat is transferred to the exterior of the integral housing 12 without the need for fins, channels or other such means for increasing external surface area. Again, this provides a space savings that results in an overall smaller housing, and also reduces manufacturing cost and complexity. Again, depending on the application, such structures could however be used to further improve thermal characteristics of the housing.

In the illustrated embodiment, heat is removed from the surface of the housing 12 by way of forced air convection. Preferably, airflow over the outer surface of portions of the integral housing 12 is provided by way of a fan mechanism 50. In addition, airflow is controlled via an airflow shell 52 that is disposed about at least a portion of the housing 12. The shell 52 is preferably constructed of a polycarbonate, or similar material, and is oriented so as to control and contain airflow. In the preferred embodiment, the fan 50 is operably connected so as to pull airflow through the shell, as is schematically represented by the arrows at A. Also, in a preferred embodiment, the x-ray tube assembly 10 is oriented at an angle of approximately 4 to 8 degrees, and the fan is positioned more efficiently with respect to hotter air, which migrates to the top interior portion formed by the shell 52. In alternative embodiments, the shell 52 may be provided with a ground plane, and thus will either include at least a portion of electrically conducting material, or may be completely fashioned from a conductive material, such as a thin layer of sheet metal.

In alternative embodiments, the interior surface of the shell 52 can be coated with a sound insulating material, such as various foam materials and the like, to further reduce noise that is emitted by the x-ray tube assembly 10.

With continued reference to FIG. 1, it is shown how in a preferred embodiment, the integral housing 12 is supported by, and affixed to, a support plate 54 by way of a plurality of stator legs, designated at 56. The stator legs are disposed about the outer periphery of the housing 12, with one end being connected to the first envelope portion 14, and the opposite end being affixed to the support plate 54.

FIG. 1 also illustrates how, in this embodiment, the rear end of the housing 12 has disposed therein an anode electrical connector assembly 60. The anode connector 60 provides the means by which the anode is placed at the predetermined voltage potential discussed above. As is shown, in this particular embodiment the anode connector 60 is connected to an external voltage source (not shown) via a high voltage connector 63 connected through the support plate 54, an electrical wire conduit 64 and a conducting means, such as screw 62. The anode connector 60 is affixed to the rear end of the housing 12 so as to form a vacuum fit therewith in any appropriate manner. In the illustrated embodiment the connection is achieved via kovar ring 66, which is welded to both the glass envelope 16 and the anode connector 60.

Preferred embodiments of the present invention further include a means for electrically insulating the evacuated housing 12. This is achieved in the illustrated embodiment by way of a stator shield 70, that is disposed substantially about the second envelope 16 portion of the housing 12, and which forms reservoirs 71, 72 and 73. Disposed within the reservoirs is a gel material. The gel used is a dielectric, and thus provides a means for electrically insulating the exterior glass surface of the envelope 16 from collecting a potential charge, and also for electrically insulating the electrical conduits 62 and 64 so as to prevent electrical arching. While in the illustrated embodiment the stator shield is illustrated as assuming a particular configuration, it will be appreciated that the shield can be formed as a single integral piece, or a multiple pieces, depending on the particular number and configuration of gel reservoirs that is desired.

Use of the gel material provides yet another important function. As noted, an undesirable effect of the rotating anode drive assembly is mechanical vibration and audible noise. The vibration can be detrimental to the operation of the x-ray tube assembly, and can, together with the audible noise, be very troublesome to the patient being treated. This is reduced by the presence of the gel material, which acts as a buffer between the integral housing 12 and any vibration or noise emitted therefrom. This buffering is improved by virtue of the fact that there is no direct mechanical connection between the housing 12 and the support plat 54; the interface is provided almost exclusively by way of the gel, which serves as a very effective mechanical buffer.

While other gels could be used, one embodiment utilizes a gel sold by Dow Corning, referred to as Dielectric Gel 3-4154. One objective is to utilize this type of gel so as to limit the noise that is emitted from the tube to less than 50 dBA. In other embodiments, the gel can be replaced with a variety of other potting compounds or encapsulants, including elastomers, electrically insulating plastics, ceramics, rubbers, cements or any combination of the foregoing.

Reference will next be made to FIGS. 2 through 6, which together depict yet another embodiment of an x-ray tube assembly, which is designated generally at 110 in the figures. As will be discussed, the embodiment illustrated in these figures includes various additional features that may be used to enhance and/or alter, for example, the cooling and electrical insulation properties of the tube assembly discussed and described above. In addition, this embodiment includes various sensors and controls to assist in preventing catastrophic failure of the tube assembly. Note that depending on the particular application involved, some or all of the various features and enhancements described in connection with FIGS. 2–6 may be utilized in a given x-ray tube assembly.

The following description of the alternative embodiment focuses on the various features and enhancements of the x-ray tube assembly that differ from, or are in addition to those already discussed in connection with the embodiment described in connection with FIG. 1. As such, only selected differences between the embodiments will be discussed below, and a description of the common components will not be repeated here. Also, although for purposes of illustration the following description focuses on an x-ray tube assembly where both the anode and the cathode are voltage biased, the concepts discussed are also applicable to tube assemblies having other voltage biasing configurations, such as anode grounded or cathode grounded systems.

Figure 2:
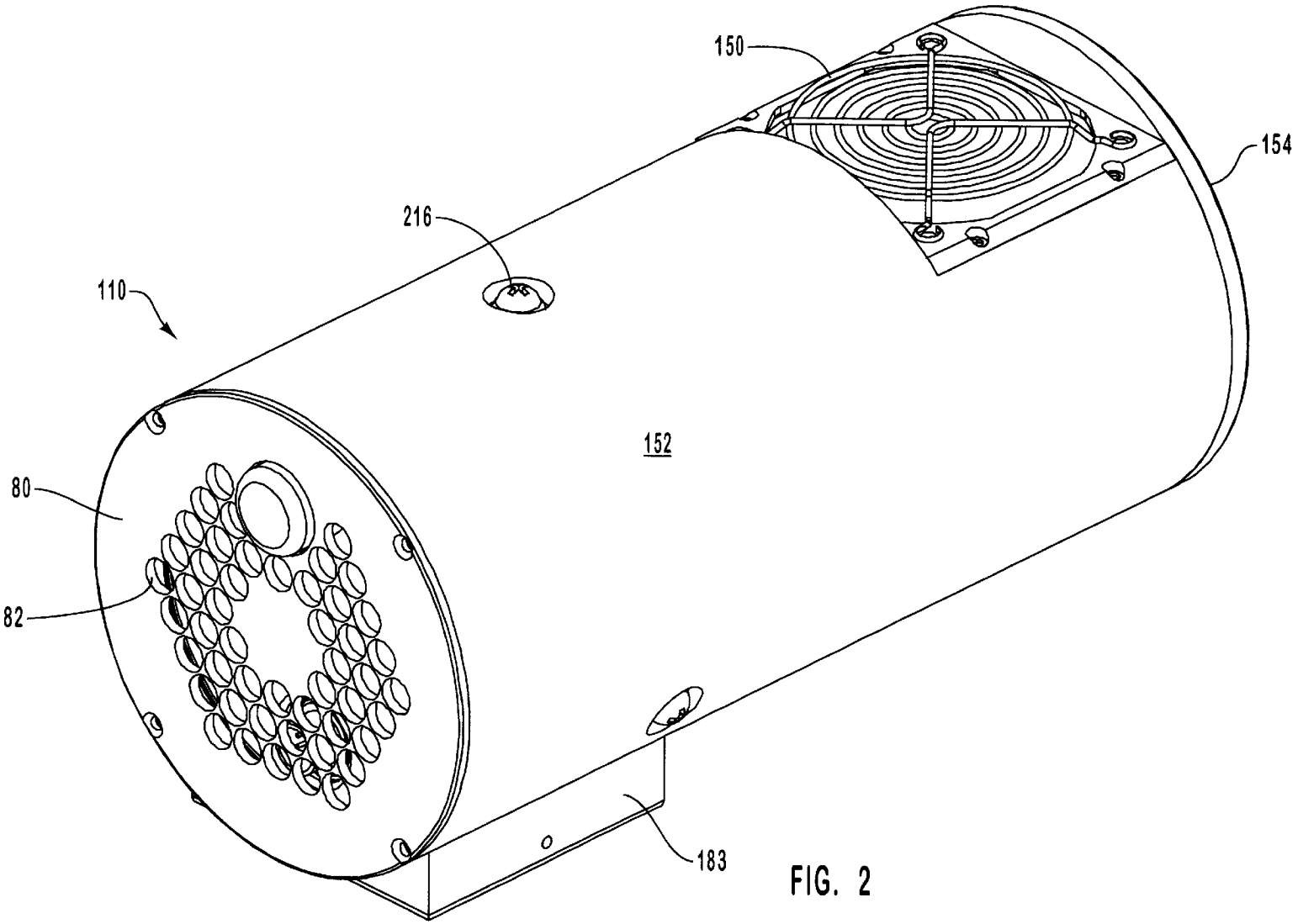
FIG. 2 is a perspective view of another embodiment of an x-ray tube having a single integral housing constructed in accordance with the teachings of the present invention.
Figure 3:
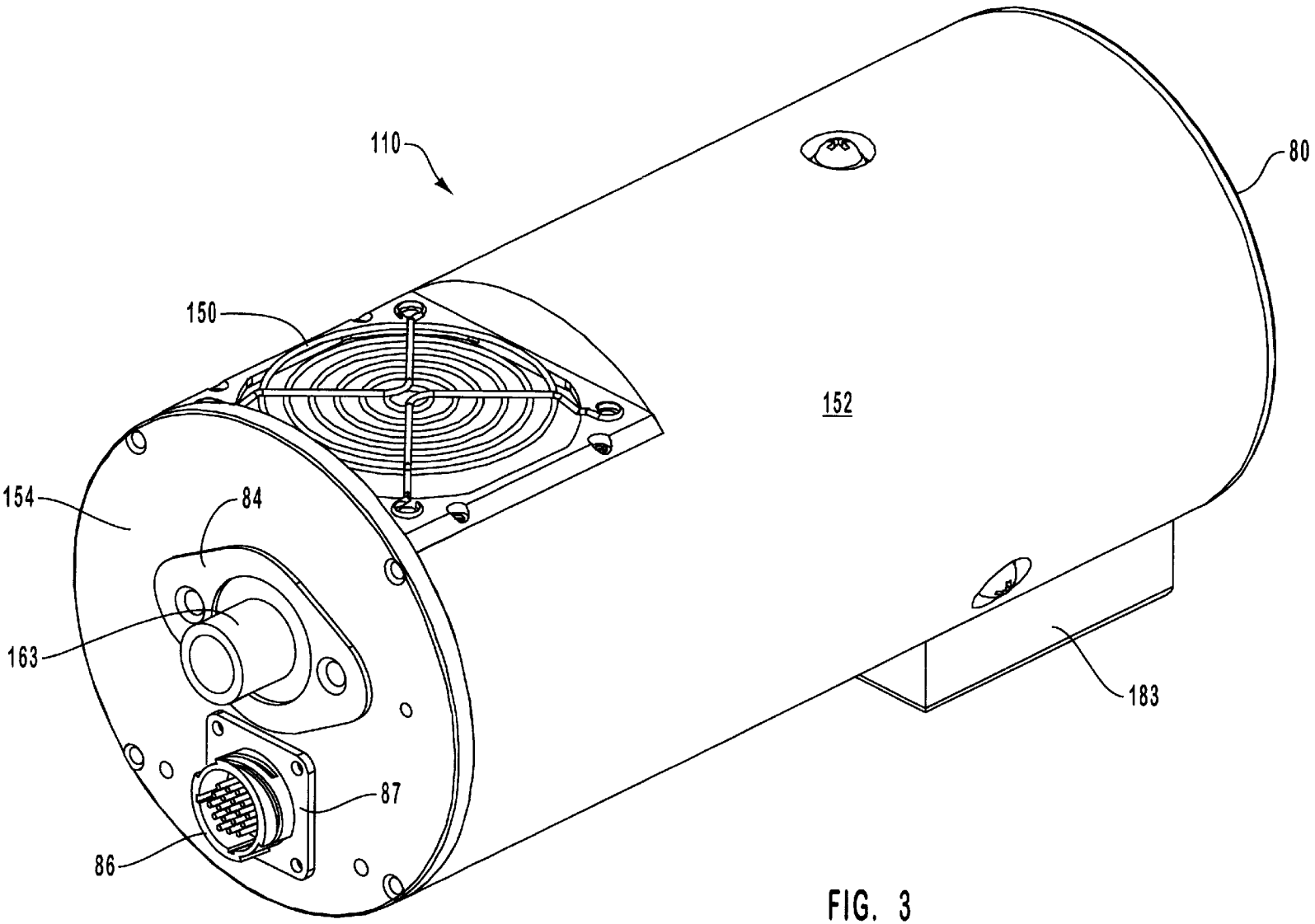
FIG. 3 is a rear perspective view of the x-ray tube of FIG. 2.

Reference is first made to FIGS. 2 and 3 together, which depict perspective views of one embodiment of an x-ray tube assembly, designated generally at 110. As is shown, the tube assembly 110 includes an outer cylindrical housing that forms an airflow shell, designated generally at 152. The airflow shell is bounded on either end by a front end cover 80 and a rear support plate 154. Though shown as comprising separate pieces that are attached to the main cylindrical body of the airflow shell 152, the front end cover 80 and/or the rear support plate 154 may be formed integrally with the shell.

The front end cover 80 provides an access point to the x-ray tube components that are disposed within the shell 152. Also, in a preferred embodiment, the front end cover 80 defines a plurality of air-flow holes 82. These holes 82 allow for the passage of air through the airflow shell 152 during tube operation in order to cool the interior of the shell, as will be discussed further below.

As is best seen in FIG. 3, the rear support plate 154 includes a high voltage connector 163, fitted with a high voltage connector attachment plate 84. Similarly, a low voltage connector 86 having a low voltage connector attachment plate 87 is also disposed on the rear support plate 154. These connectors enable the electrical connection of the various electrical components disposed within the tube assembly 110, as was described generally above in connection with the embodiment of FIG. 1.

FIGS. 2 and 3 also illustrate a portion of a fan assembly 150 disposed in the airflow shell 152. Also formed through the shell 152 is a window block assembly 183, which includes an x-ray transmissive window 140 through which the x-rays pass during tube operation. The moving components (not shown) of the fan assembly 150 are preferably recessed into the airflow shell 152 a sufficient distance to enable the shell and rear support plate 54 to protect the fan from inadvertent contact with other objects.

Figure 4:
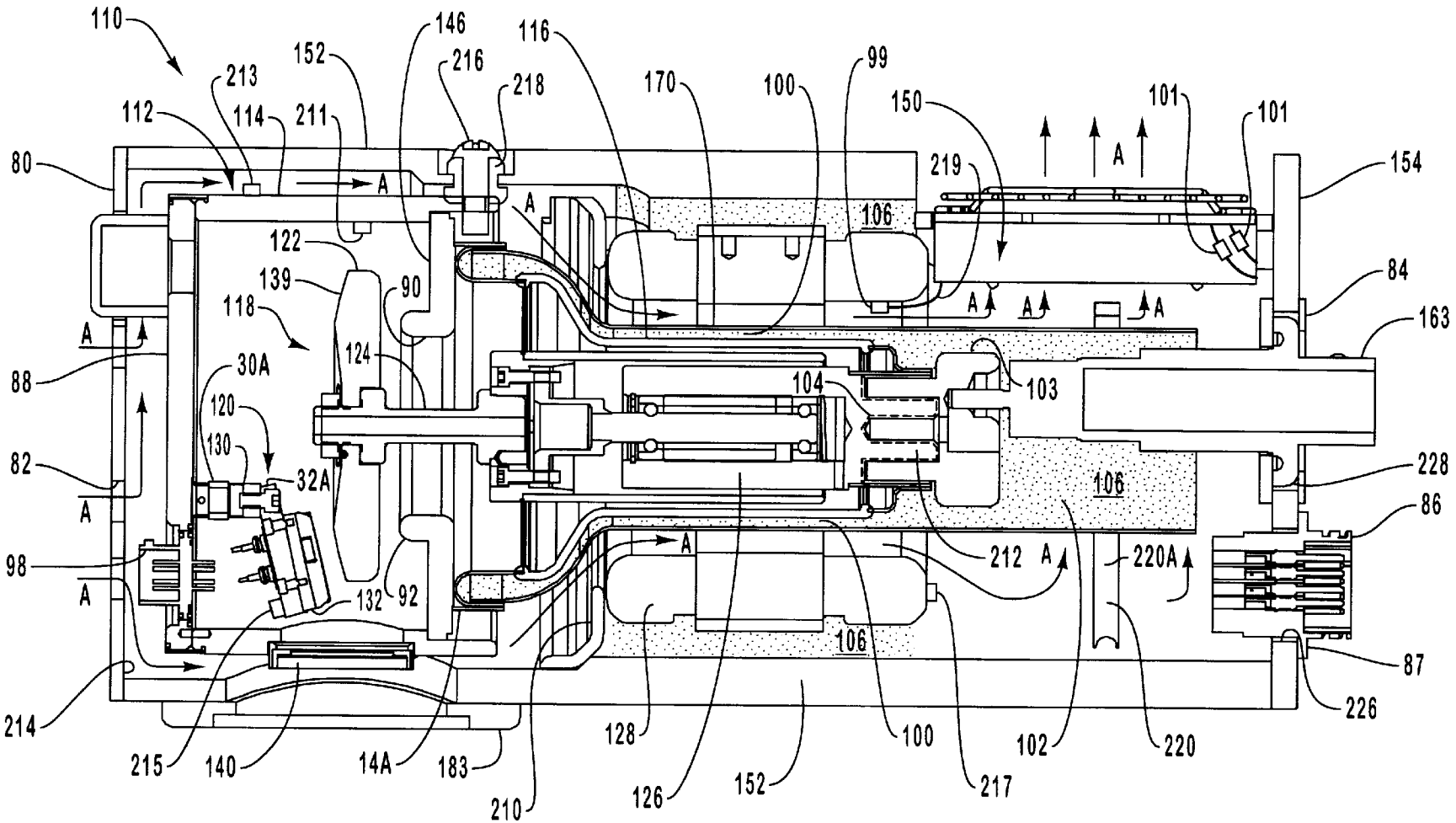
FIG. 4 is a cross-sectional elevational view of the x-ray tube of FIG. 2.
Figure 5:
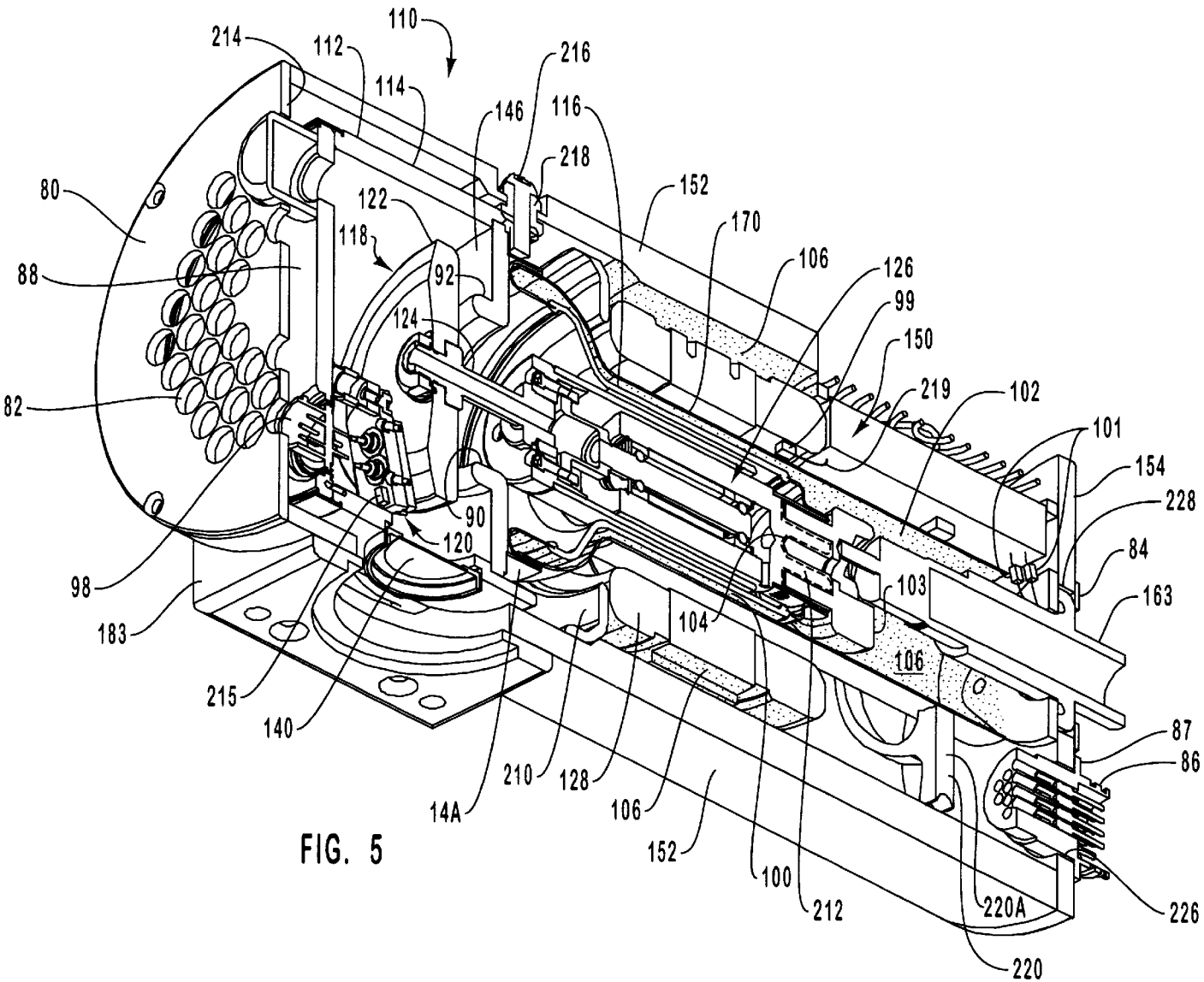
FIG. 5 is a cross-sectional front perspective view of the x-ray tube of FIG. 2.
Figure 6:
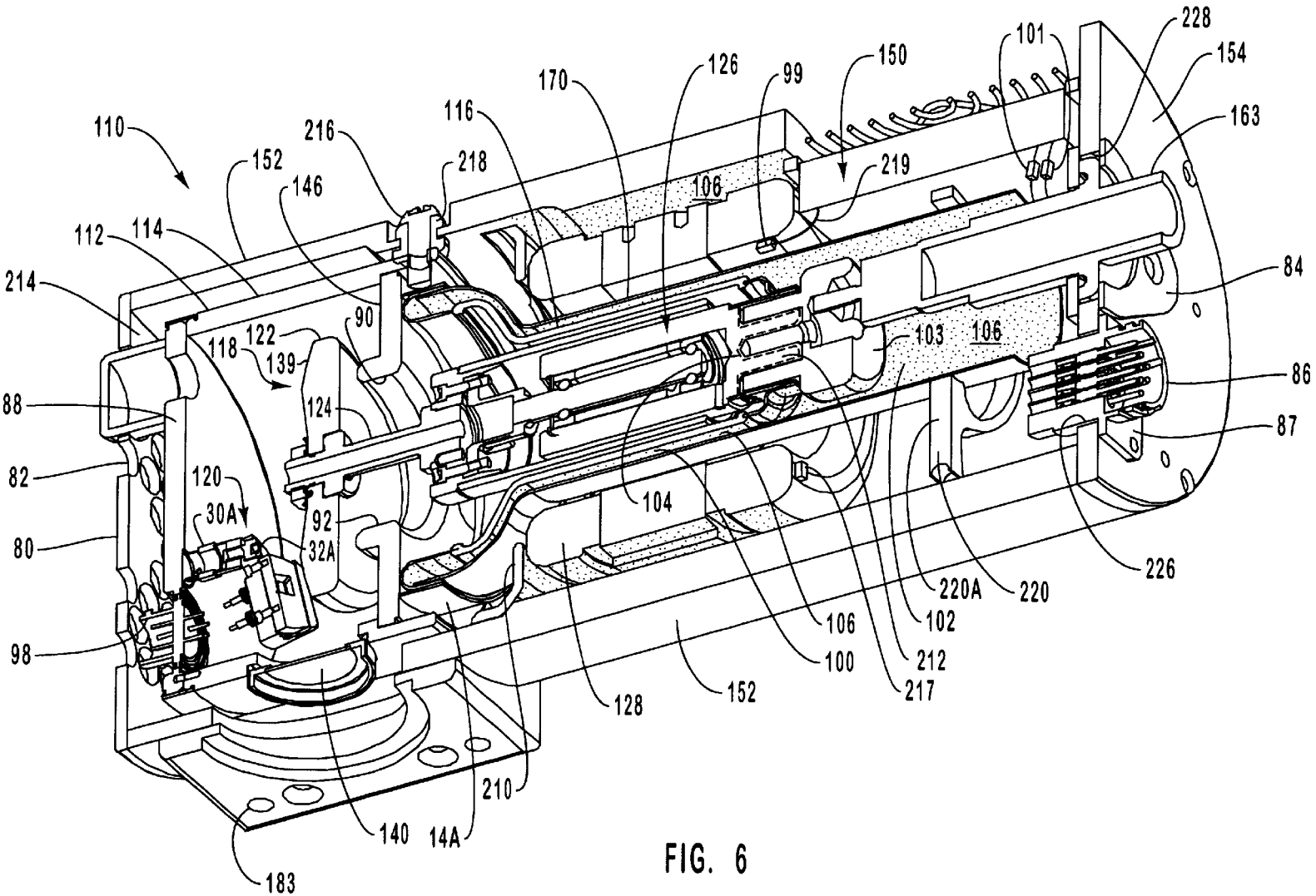
FIG. 6 is a cross-sectional rear perspective view of the x-ray tube of FIG. 2.

Reference is next made to FIGS. 4, 5, and 6, which together depict different views of the internal components of the x-ray tube assembly 110. As is shown, in this particular embodiment, the airflow shell 152 houses all of the tube components, including an integral housing 112. As before, the integral housing 112 forms an evacuated envelope that houses a cathode assembly 120 and an anode assembly 118. Also, as in the previous embodiment, the integral housing 112 is formed from a first envelope portion 114 and a second envelope portion 116. Again, it will be appreciated that in some embodiments, the integral housing may be formed as a single integral piece, or from more than two component pieces.

As was discussed in connection with the embodiment of FIG. 1, in a preferred embodiment, at least the first envelope portion 114 is constructed of a material that provides a sufficient level of radiation blocking so as to eliminate the need for additional x-ray blocking shields external to the integral housing 112. Again, in lower power applications such as mammography, copper or a copper alloy of sufficient thickness is appropriate. Of course, other similar materials could be used. For example, stainless steel or stainless steel alloys could be used. Alternatively, in some applications the envelope 114 can be formed from a material providing a higher level of radiation blocking. For example, the materials disclosed and discussed in pending U.S. patent application Ser. No. 09/491,416 filed Jan. 26, 2000 and/or U.S. patent application Ser. No. 09/694,568 filed Oct. 23, 2000 could be used. Both of those applications are incorporated herein by reference.

In the embodiment shown, the first envelope portion 114 includes a first end 88 that is positioned substantially adjacent to the front end cover 80. The first envelope portion 114 also includes a second end, referred to as the anode plate 146. The anode plate 146 defines an aperture 90 through which the shaft 124 of the anode assembly 118 extends. Again, the anode plate 146 is designed to prevent radiation from passing through the aperture 90 into the interior of the second envelope portion 116. To do this, the anode plate 146 preferably comprises an x-ray absorbing material—and preferably is the same material as that used in the first envelope portion 114 (although a different material could optionally be used). Again, when used in a low energy application such as mammography, a material such as copper, stainless steel, or alloys thereof could be used as previously discussed. In higher energy applications, a material, or combination of materials, having stronger x-ray blocking characteristics may be used, such as those disclosed in the aforementioned U.S. patent applications.

To further prevent the passage of x-rays through the aperture 90, a sleeve or lip portion 92 is formed along an edge of the anode plate 146 along the aperture so as to extend from the surface of the anode plate 146 in the direction of the anode assembly 118. This sleeve 92 is preferably formed integrally with the anode plate, and is preferably comprised of the same material as the plate.

In the illustrated embodiment, the first envelope portion 114 also includes an alignment collar 14A, which extends beyond the anode plate 146. This collar 14A is used to help align the first envelope portion 114 with respect to the second envelope portion 116 during tube manufacture.

As is best seen in FIG. 4, the cathode assembly 120 generally comprises a filament (not shown), the cathode head 132, and the mounting arm 130. The cathode head 132, which houses the filament, is preferably constructed of a high atomic number material and is positioned so as to prevent the leakage of radiation through the cathode connector 98 disposed in the first end 88 of the first envelope portion 114. Materials having suitably high atomic numbers from which the cathode head 132 could be constructed include, but are not limited to, iron nickel, molybdenum, copper and alloys thereof. Of course, the material comprising the cathode head 132 may be altered in order to suit the radiation absorption requirements of the particular tube application.

In the illustrated embodiment, the mounting arm 130 preferably includes an insulating portion 30A constructed from an electrical insulator, such as ceramic or glass. This enables the length of the mounting arm 130 to be minimized, which in turn minimizes the overall length of the tube assembly 110. This is especially advantageous in certain applications. For example, in a typical mammography scan, the tube assembly is positioned extremely close to the patient's shoulder and a shorter tube assembly results in less discomfort for the patient.

In some applications, the electrical insulating portion 30A of the mounting arm 130 may be replaced by a metal bushing, as will be appreciated by one of skill in the art. Further, the mounting arm 130 in some applications may be entirely eliminated; instead, the cathode head 132 may be directly attached to or integrated directly into the wall of the first envelope portion 114, such as the first end 88. This approach would further reduce the space required for the cathode assembly 120, and would provide the advantage of further shortening the overall length of the tube assembly.

In the illustrated embodiment, the cathode head 132 is mechanically attached to the cathode mounting arm 130 via an extension 32A that receives a screw therethrough. The cathode head 132 is preferably angled with respect to the extension 32A such that no adjustment to the cathode head is necessary in order to align the filament with the anode target 122. This reduces complexity and reduces assembly time during tube manufacture. It also improves spacing repeatability between the cathode head and the anode target, which in turn improves focal spot and tube emission quality and predictability.

As with the embodiment of FIG. 1, the tube assembly 110 includes a stator shield, designated at 170. The stator shield 170 shown here is substantially disposed about the second envelope portion 116 of the integral housing 112 so as to define a gap 100. The stator shield 170 also longitudinally extends beyond the second envelope portion 116 to further define a cylindrical volume 102. In this embodiment, the high voltage connector 163, attached to the support plate 154, extends into this cylindrical volume 102 and connects either directly or indirectly to a heat sink 103.

Given its position proximate the integral housing 112, the stator shield 170 is preferably constructed of a material that is able to withstand high temperatures and that possesses low flammability, volatility, and toxicity characteristics. These characteristics are desirable so that, in the unlikely event of a catastrophic failure of the tube assembly 110, smoke production from the stator shield 170 and similar components is minimized. In the present embodiment, the stator shield 170 comprises V-0 plastic, though other materials that meet the above characteristics may be acceptably used in constructing the shield. V-0 plastic and similar materials may also be employed in other areas of the tube where the above characteristics are desired.

The stator assembly 128 shown in FIGS. 4–6 is disposed substantially about both the stator shield 170 and the second envelope portion 116. The stator is electrically connected to a suitable power source (not shown) via the low voltage connector 86 disposed in the support plate 154. In one preferred embodiment, a positive temperature coefficient thermistor or resistor (not shown) is disposed in the electrical ground connection to the stator 128 to prevent continued stator operation in the event that an electrical stator failure is experienced.

In this embodiment, the x-ray tube assembly 110 includes a means for insulating components of the tube assembly 110, such as the stator 128 and the second envelope portion 116. For example, in one embodiment, this electrical insulation means comprises a potting material, depicted at 106, that is disposed at various locations within the tube assembly to insulate these components. Depending on the needs of the particular application, this potting material, or encapsulant, may provide any one of several functions. For example, the material may serve as an electrical insulator, so as to provide a level of electrical insulation between various tube components. In the illustrated embodiment, it electrically insulates the high voltage (or ground—depending on the configuration used) connection to the anode assembly, thereby preventing electrical arcing and charge-up of the integral housing (especially in embodiments having a glass portion). In addition, the potting material may also preferably act as a thermal conductor to assist in the removal of heat from within the tube assembly 110. In this case, it would be comprised of a material exhibiting a level of thermal conductivity characteristics. In addition, the potting material may also function as a dampening material, and thereby assist in abating acoustic and vibrational noise created by components such as the stator 128, the fan 150 and the rotating anode structure, during operation of the tube assembly 110.

Depending on the particular functional characteristics required, a number of different potting materials 106 should be used. Preferably, the material is capable of withstanding the high temperatures encountered within the operating tube. Moreover, the material preferably exhibits a relatively low durometer, so that it can be easily applied to the relevant sections of the tube, such as the gap 100 and volume 102. Materials such as elastomers, dielectric gels, insulative plastics, ceramics, cements, or any suitable combination of the above could be used for the potting material 106. By way of example, in one preferred embodiment the potting material 106 comprises a silicone rubber material, known by the tradename Sylgard® available from Dow Coming and set up in the ratio 3A to 1B.

As mentioned above, the potting material 106 is disposed in various areas of the tube assembly 110 where such characteristics as thermal conduction, electrical isolation, and sound and vibration abatement are desired. In the illustrated embodiment, the potting material 106 is disposed in the gap 100 and in the cylindrical volume 102. The potting material 106 is also interposed between the outer periphery of the stator 128 and the inner surface of the airflow shell 152 adjacent the stator. So disposed, the potting material 106 electrically isolates both the stator 128 and the second envelope portion 116 from the airflow shell 152 and other tube components. Further, the potting material 106 assists in tube cooling by absorbing heat emitted by the second envelope portion 116, the stator 128, and the heat sink 103, then transmitting that heat to cooling air that, as explained below, is continually circulated through the tube assembly 110. Finally, noise created by internal tube components is absorbed by the potting material 106, thus allowing for quieter operation of the tube assembly 110, and reducing possible stress upon the patient.

A radio-opaque material may be added to the potting material 106 in order to provide enhanced radiation shielding to the tube assembly 110. In the present embodiment, for instance, bismuth trioxide is combined with the potting material 106 disposed in the above-mentioned areas to prevent radiation escape from the tube assembly 110. Alternatively, zinc oxide, barium sulfate, or other similar radio-opaque materials may be added to the potting material 106 in order to provide the desired radiation shielding characteristics.

The addition of radio-opaque materials is not limited to the potting material 106. The radio-opaque materials discussed above may also be integrated into the high voltage connector 163, the low voltage connector 86, and their attachment plates 84 and 87, as well as other tube components in order to provide enhanced radiation shielding.

In addition to the cooling enhancements provided by the potting material 106, the tube assembly 110 is also cooled via forced air convection as in the previous embodiment discussed above. An airflow path is defined through the tube interior adjacent several of the tube components that create or radiate heat during x-ray production in order to remove heat therefrom. The fan 150 continually circulates cooling air through the airflow path, as indicated by the arrows A in FIG. 4, so that heat from the tube components is absorbed by the air and efficiently removed from the tube assembly 110. This heat removal enables the tube to function at an acceptable temperature level.

In preferred embodiments, the airflow path is designed to evenly distribute cooling air about the tube components disposed in the tube assembly 110. Though the details below describe a preferred airflow configuration for the tube assembly 110, modifications thereto as may be required for a particular application are understood to reside within the scope of the present invention. In the illustrated embodiment, cooling air is continually drawn into the interior of the tube assembly 110 during tube operation via the holes 82 defined in the front end cover 80. The air is then directed between the outer surface of the first envelope portion 114 of the integral housing 112 and the airflow shell 152, where a substantial amount of heat is absorbed from the envelope portion. In the illustrated embodiment, an air diverter 210, which is also used to structurally support the stator 128 and contain the potting material 106, functions to direct the airflow between the inner periphery of the stator and the stator shield 170, where the air absorbs heat radiated from these components. Note that in this particular embodiment, the air diverter 210 additionally serves as a magnetic shield for preventing fields created by the stator 128 from interfering with the focusing of electrons onto the anode target 122. The airflow continues along the outer surface of the stator shield 170, absorbing heat received by the shield from the anode assembly 118, the heat sink 103, and the potting material 106. The air is then ejected from the tube assembly 110 via the fan 150. This cooling process is continuously performed during tube operation.

The fan 150 is an integral component of the air cooling system described above. It is designed to be easily removable from the airflow shell 152, thus enabling it to be field serviced. The present embodiment utilizes a variable speed fan. This enables one or more thermal sensors 99 to be disposed at strategic locations within the tube assembly 110 to monitor the temperature therein. When an increase in temperature is detected by the thermal sensors, the speed of the fan 150 is increased to augment the amount of airflow through the tube assembly 110. Correspondingly, when cooler temperatures are sensed the fan speed may be adjusted accordingly to reduce the airflow. Additionally, the electrical leads of the fan 150 may be fitted with filter capacitors 101, if desired, to enable the sensing of low-level back-emf signals from the stator 128.

As is known, cooling of the anode assembly 118 is especially critical in x-ray tube applications. To assist this cooling, the shank end 212 of the rotor assembly 126 is fitted with a heat sink 103 to dissipate heat from the anode assembly, and especially the rotor assembly 126 (bearing surfaces, etc.). The heat absorbed by the heat sink 103 from the shank 212 is transmitted to the potting material 106 disposed about the heat sink. This heat is then conducted to the stator shield 170 and removed by the cooling air that continually circulates past the stator shield 170 during tube operation, as described above.

The conduction of heat from the shank 212 to the heat sink 103 may be enhanced by a thermal coating 104 interposed between the shank and the heat sink. While other materials could be used, in the illustrated embodiment the thermal coating 104 comprises a mixture of fluorinated grease, known as Krytox, and boron nitride. In a preferred embodiment, the mixture includes approximately 60% by weight Krytox and 40% by weight boron nitride. However, other proportions could be used. The thermal coating 104 is applied to either or both of the contacting surfaces of the shank 212 and the heat sink 103 to facilitate greater heat transfer therebetween. Significantly, the thermal coating 104 as described herein is heat resistant, thus preventing it from melting or dissipating during tube operation. Other coatings or materials that are thermally conductive and heat resistant may alternatively be used to perform the same functionality. Additionally, the thermal coating 104 may be employed in other areas of the tube assembly 110 where enhanced heat transfer is desired.

The heat sink 103 may also serve as the electrical interface between the high voltage connector 163 and the anode assembly 118, depending on the voltage configuration of the tube assembly 110. This is so in double-ended or cathode grounded tube assemblies, for instance. As seen in the exemplary embodiment of FIGS. 4–6, the high voltage connector 163 is disposed within the cylindrical volume 102 of the stator shield 170 such that the connector is electrically attached to the heat sink 103. As mentioned above, electrical isolation between the high voltage connector 163 and the stator shield 170 is achieved via the potting material 106 disposed about the high voltage connector in the cylindrical volume 102. Again, the direct high voltage connector-to-heat sink connection described here allows the length of the tube assembly 110 to be further minimized. Alternatively, the high voltage connector 163 need not directly contact the heat sink 103, but rather may be connected thereto via an electrical wire conduit and screw, similar to the conduit 64 and screw 62 shown in FIG. 1 of the previous embodiment. In this case, electrical isolation of the high voltage connector 163, the electrical wire conduit 64 and the screw 62 is also achieved via the potting material 106, which is substantially disposed about these components.

The x-ray tube assembly 110 may also include various features for safeguarding its thermal and operational integrity. These features have as their primary function the monitoring and control of critical tube operations such that the tube remains undamaged in the unlikely event of failure of one or more tube components. Again, some or all of these features may be implemented depending on the needs of any particular application.

For instance, thermal sensors may be disposed within the tube assembly 110 to monitor the inner tube temperature. These sensors may be coupled with an exterior gauge (not shown) to notify operating personnel of the tube environment. These sensors may be resettable or non-resettable, according to the requirements of the particular tube application. Alternatively, or in addition to the gauge, the thermal sensors may also comprise a thermistor, thermocouple, fuse, switch, or similar control device to limit or interrupt operation of the tube should excessive temperatures be reached within the tube assembly 110. In like manner, one or more humidity sensors/switches 211 may be located within the tube assembly 110 to prevent operation thereof should unsafe moisture levels exist within the tube.

Preferably, various areas of the tube assembly 110 are ideally suited for the disposal of sensors and/or switches as explained above. Several non-limiting examples are given here. A thermal sensor/switch 213 may be disposed on a portion of the integral housing 112 to interrupt the operation of the stator 128 and/or filament in the event that excessive temperatures are sensed within the housing. The thermal sensor/switch 213 may be disposed on the inner or outer surface of the integral housing 112 to perform this operation, as one skilled in the art will appreciate. A current or voltage sensor/switch 215 may be interconnected with the cathode assembly 120 to prevent the filament from overcurrent conditions, which may irretrievably damage the filament if not detected. Redundant thermal switches 217, such as that shown in FIG. 4, may be disposed at various locations about the stator 128 to detect dangerous heat levels and interrupt tube operation if necessary. Note that the various controls mentioned above may incorporate thermistors or varistors to allow the controls to operate in the desired manner.

In addition to the above sensors and controls, other features may be included in the present embodiment of the tube assembly 110 to improve its safety and performance. For example, high temperature wire insulation 219, such as that shown in connection with the thermal sensor 99, is preferably employed in areas of the tube, such as near the stator 128, or regions filled with potting material 106, where relatively high levels of heat may be encountered by electrical wires. This helps to protect the wires from heat damage. As another example, resistors (not shown) may be incorporated into the electrical wiring of the anode assembly 118 or the cathode assembly 120 to further reduce the likelihood for electrical arcing within the tube assembly 110.

In the unlikely event of a catastrophic failure of the tube assembly 110, several features are incorporated into the design of the present embodiment to minimize the damage created thereby. For instance, the use of plastic is reduced in the present tube assembly 110. In areas where plastic is employed, such as the stator shield 170, high temperature plastic is used. Also, the outer region 214 of the inner surface of the front end cover 80 serves as a fluid barrier that may be used to stop the flow of any melted plastic produced as a result of the high temperatures associated with a catastrophic tube failure.

The tube assembly 110 may also include various features intended to enhance the alignment and integrity of the tube assembly 110 and its components. For example, the airflow shell 152 is preferably affixed to a portion of the integral housing 112 via a plurality of mechanical fasteners, such as screws 216. The screws 216 are preferably composed of a low thermally conducting material, such as 304 stainless steel, in order to minimize heat transfer through the screw to the outer surface of the airflow shell 152. A cap or potting material 106 (not shown) may be disposed on the head of each screw 216 to further reduce heat transfer.

In the illustrated embodiment, vibration isolating bushings 218 are disposed about each screw 216 to help align the airflow shell 152 with the integral housing 112. As their name implies, the vibration isolating bushings 218 also help eliminate relative vibration between the tube interior and the airflow shell 152. The vibration isolating bushings 218 are preferably constructed to withstand high temperatures. Again, this lowers the noise and vibration of the operating x-ray tube, further improving patient and operator comfort.

As best seen in FIGS. 5 and 6, a stator shield support member 220 is disposed about the stator shield 170 to support it within the tube assembly 110 while minimizing vibrational stresses thereto. The support member 220 is composed of an electrically non-conducting material so as to minimize high voltage creep and electrical condensation thereon. It comprises several legs 220A that extend between the stator shield 170 and the airflow shell 152, wherein the legs are shaped to minimize the restriction of airflow past the stator shield.

Reference is now made to FIGS. 3 and 6, wherein various features of the low voltage and high voltage connectors 86 and 163 are depicted. Both the low voltage connector 86 and the high voltage connector 163 are fitted with the attachment plates 87 and 84, respectively. These attachment plates 87 and 84 may be integrally formed with the connector, as is seen with the low voltage connector 86, or may be operably attached thereto, as is the case with the high voltage connector 163 shown in the figures. Appropriately sized mounting holes 226 and 228 are disposed in the support plate 154 to receive the low voltage connector 86 and the high voltage connector 163, respectively. The attachment plates 87 and 84 are preferably fastened to the support plate 154 via mechanical fasteners such as screws or bolts. The mounting arrangement described here facilitates simple assembly of the tube assembly 110, thereby reducing manufacturing time.

As best seen in FIG. 6, the low voltage connector 86 functions as an integral terminal block, to which electrical wires (not shown) disposed outside the tube assembly 110 may be connected to the exterior side of the connector, and to which electrical wires (not shown) leading from inner tube components may be connected to the interior connector side. This simplifies the wiring process during manufacture of the tube assembly 110, and helps reduce the length of electrical wiring inside the tube assembly 110. This, in turn, helps reduce the likelihood of entanglement of interior electrical wires with the fan 150. Similarly, the cathode connector 98 may also be configured as an integral terminal block.

In summary, the above described x-ray tube assemblies provide a variety of benefits not previously found in the prior art. A tube assembly utilizing the described integral housing is particularly useful in mammography types of applications. In particular, the integral housing eliminates the need for a second external housing, as well as the need for a fluid coolant cooling system. Effective heat removal is accomplished without the need for external fins or channels for heat transfer on the integral housing. Moreover, the integral housing provides sufficient radiation blocking, and does not require a separate internal cathode blocking plate structure. All of this is accomplished with a smaller dimensioned outer housing structure. This results in a single x-ray tube integral housing that can be constructed in a smaller space, and that can utilize, for instance, a larger rotating anode disk, which further improves the thermal performance of the x-ray tube. Moreover, the assembly utilizes a unique dielectric gel that provides for both electrical isolation of the integral housing, and also greatly reduces noise that is emitted during operation.

An alternative embodiment of the present x-ray tube assembly provides enhanced thermal protection of tube components by utilizing a thermal potting material that also serves to electrically isolate various tube components. The airflow path through the tube assembly is optimized to provide maximum cooling thereof during x-ray production. Various sensors and controls are also disposed in the tube assembly to monitor the operation thereof and to prevent excessive heat buildup therein.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray tube having an electron producing cathode and an anode target positioned to receive the electrons produced by the cathode, the x-ray tube comprising:

a first envelope portion formed with an x-ray absorbing material, wherein the anode target and the cathode are substantially disposed within a first cavity formed by the first portion; and a second envelope portion forming a second cavity, the second envelope being affixed to the first envelope portion in a manner so that the first and second cavities together form an integral vacuum enclosure;

a shell disposed substantially about the first and the second envelope portions so as to define an airflow path along at least a portion of an outer surface of the first and the second envelope portions; and an insulating material disposed within at least a portion of the shell.

2. An x-ray tube as defined in claim 1, further comprising a shield at least partially disposed about the second envelope portion so as to define a gap, and wherein at least some of the insulating material is disposed within said gap.

3. An x-ray tube as defined in claim 1, wherein the insulating material is thermally conductive.

4. An x-ray tube as defined in claim 1, wherein the insulating material reduces the amount of noise emitted from the x-ray tube.

5. An x-ray tube as defined in claim 1, wherein the insulating material is an electrical insulator.

6. An x-ray tube as defined in claim 1, wherein the insulating material comprises a material selected from the group consisting of: an elastomer, dielectric gel, plastic, ceramic, cement, rubber, and combinations thereof.

7. An x-ray tube as defined in claim 1, wherein the insulating material includes a radio-opaque material.

8. An x-ray tube as defined in claim 7, wherein the radio-opaque material is selected from the group consisting of: bismuth trioxide, zinc oxide, and barium sulfate.

9. An x-ray tube as defined in claim 1, further comprising a shield that extends distally from the second envelope portion so as to form a volume, wherein at least a portion of the volume contains at least a portion of the insulating material.

10. An x-ray tube as defined in claim 1, wherein the x-ray absorbing material of the first envelope portion comprises copper or a copper alloy.

11. An x-ray tube as defined in claim 1, wherein the x-ray absorbing material of the first envelope portion comprises stainless steel or a stainless steel alloy.

12. An x-ray tube as defined in claim 1, wherein at least a portion of the cathode comprises an x-ray absorbing material so as to form an x-ray blocking shield that prevents substantially all radiation from exiting the vacuum enclosure through an aperture formed through the first envelope portion.

13. An x-ray tube as defined in claim 12, wherein the x-ray absorbing material of the cathode comprises material selected from the group consisting of iron nickel, molybdenum, and copper.

14. An x-ray tube as defined in claim 1, further comprising a fan disposed substantially within the shell and oriented so as to force air through the airflow path.

15. An x-ray tube as defined in claim 1, wherein at least a portion of an anode rotor assembly, rotatably connected to the anode target, is disposed within the second envelope portion, and wherein a heat sink is thermally attached to the anode rotor assembly.

16. An x-ray tube as defined in claim 15, wherein the heat sink is substantially disposed within a volume defined by a shield, and wherein an insulating material is a least partially disposed within the volume.

17. An x-ray tube as defined in claim 15, wherein a thermally conductive layer is interposed between the anode rotor assembly and the heat sink.

18. An x-ray tube as defined in claim 17, wherein the thermally conductive layer comprises a mixture of fluorinated grease and boron nitride.

19. An x-ray tube as defined in claim 1, wherein a plurality of air flow conduits are formed through the shell.

20. An x-ray tube as defined in claim 1, further comprising thermal sensors capable of monitoring the temperature of the x-ray tube.

21. An x-ray tube as defined in claim 2, further comprising at least one shield support member extending between the shield and the shell, wherein the shield support member is electrically non-conducting.

22. An x-ray tube as defined in claim 1, wherein the shell is attached to the integral vacuum enclosure via a plurality of screws having low thermally conductivity.

23. An x-ray tube as defined in claim 22, further comprising a plurality of vibration isolating bushings disposed between the shell and the integral housing, wherein the screws each extend through one of the plurality of bushings.

24. An x-ray tube as defined in claim 2, wherein the shield comprises a plastic material.

25. An x-ray tube as defined in claim 1, further comprising a radiation blocking plate comprised of an x-ray absorbing material that is disposed between the first envelope portion and the second envelope portion.

26. An x-ray tube as defined in claim 25, wherein the radiation blocking plate includes a lip disposed about an aperture formed through the plate and extending in a direction towards the interior of the first envelope portion.

27. An x-ray tube as defined in claim 1, wherein the cathode is mounted on a support arm affixed to an interior surface of the first envelope portion, and wherein at least a portion of the support arm is comprised of an electrical insulator material.

28. An x-ray tube comprising:

an integral housing forming a vacuum enclosure having a first interior portion and a second interior portion, the first interior portion having disposed therein an electron producing cathode and a rotating anode target positioned to receive the electrons produced by the cathode, the second interior portion having substantially disposed therein an anode rotor assembly rotatably supporting the anode target via a rotating shaft;

a radiation blocking plate comprised of an x-ray absorbing material that is disposed between the first interior portion and the second interior portion, wherein a the shaft passes through an aperture formed through the plate;

a shield disposed about at least a portion of the integral housing so as to define a gap between the shield and an outer surface of the housing, and wherein an electrically insulating potting material is disposed in at least a portion of the gap; and a shell disposed about the vacuum enclosure so as to define at least one airflow path.

29. An x-ray tube as defined in claim 28, wherein at least a portion of the vacuum enclosure proximate to the first interior portion is comprised of an x-ray absorbing material.

30. An x-ray tube as defined in claim 28, wherein at least a portion of the vacuum enclosure proximate to the second interior portion comprises glass.

31. An x-ray tube as defined in claim 28, wherein at least a portion of the cathode comprises an x-ray absorbing material.

32. An x-ray tube as defined in claim 31, wherein the x-ray absorbing material of the cathode comprises material selected from the group consisting of iron nickel, molybdenum, and copper.

33. An x-ray tube as defined in claim 28, further comprising a mounting arm attached to an interior surface of the first interior portion, wherein the mounting arm structurally supports the cathode.

34. An x-ray tube as defined in claim 33, wherein the mounting arm comprises ceramic or glass.

35. An x-ray tube as defined in claim 33, wherein the cathode is angled with respect to the mounting arm.

36. An x-ray tube as defined in claim 28, further comprising a heat sink thermally attached to the anode rotor assembly.

37. An x-ray tube as defined in claim 36, wherein a thermally conductive layer is interposed between the anode rotor assembly and the heat sink.

38. An x-ray tube as defined in claim 37, wherein the thermally conductive layer comprises a mixture of fluorinated grease and boron nitride.

39. An x-ray tube as defined in claim 28, wherein the potting material is thermally conductive.

40. An x-ray tube as defined in claim 28, wherein the potting material includes a includes a radio-opaque material.

41. An x-ray tube as defined in claim 28, wherein the potting material comprises a material selected from the group consisting of: elastomer, dielectric gel, plastic, ceramic, cement, rubber, and any combination thereof.

42. An x-ray tube as defined in claim 28, wherein the potting material comprises silicone rubber.

43. An x-ray tube as defined in claim 28, wherein the includes a plurality of air inlet holes.

44. An x-ray tube as defined in claim 28, further comprising a fan at least partially disposed within the shell, wherein the fan directs air along the at least one airflow path.

45. An x-ray tube as defined in claim 44, wherein the fan is capable of rotating at multiple speeds.

46. An x-ray tube as defined in claim 45, further comprising thermal sensors disposed within the shell to control the speed of the fan.

47. An x-ray tube as defined in claim 28, further comprising a voltage connector extending through a hole formed in the shell and electrically connected to the anode assembly, and wherein at least a portion of the voltage connector is disposed within a electrically insulating potting material.

48. An x-ray tube as defined in claim 47, wherein the voltage connector is thermally connected to a heat sink.

49. An x-ray tube as defined in claim 28, further comprising a shield support a member extending between the shield and the shell, wherein the shield support member is electrically non-conducting.

50. An x-ray tube as defined in claim 28, wherein the shell is attached to the integral housing via low thermally conductive screws.

51. An x-ray tube as defined in claim 50, further comprising a plurality of vibration isolating bushings disposed between the shell and the integral housing, wherein the screws each extend through one of the plurality of bushings.

52. An x-ray tube as defined in claim 28, further comprising at least one air diverting structure positioned so as to direct the airflow path in a predetermined direction.

53. An x-ray generating apparatus comprising:

an integral housing forming a vacuum enclosure, at least a portion of the housing being formed of a material capable of providing a predetermined level of radiation shielding;

an anode assembly having a rotating anode with a target portion, the rotating anode being disposed within the vacuum enclosure;

an electron source capable of emitting electrons that strike the target portion to generate x-rays which are released through a window formed through a side of the integral housing; and a shield disposed about at least a portion of the integral housing so as to form at least one gap between the shield and an outer surface of the housing, wherein an electrically insulating material is disposed within at least a portion of the gap.

54. An x-ray generating apparatus as defined in claim 53, wherein the electrically insulating material includes a radio-opaque material.

55. An x-ray generating apparatus as defined in claim 53, further comprising a shell disposed at least partially about an outer periphery of the integral housing, the shell defining an airflow path capable of directing air flow over at least a portion of an outer surface of the integral housing.

* * * * *